United States Patent [19]

Kingsley

[11] 4,076,183

[45] Feb. 28, 1978

[54] PHOTOCONDUCTOR INCREMENTING APPARATUS

[75] Inventor: William Kingsley, Rochester, N.Y.

[73] Assignee: Xerox Corporation, Stamford, Conn.

[21] Appl. No.: 769,984

[22] Filed: Feb. 18, 1977

[51] Int. Cl.[2] ..... B65H 17/02; B65H 75/02

[52] U.S. Cl. ..... 242/67.3 R; 242/55

[58] Field of Search ..... 242/55, 67.1 R, 67.3 R; 355/16

[56] References Cited

U.S. PATENT DOCUMENTS

| | | | |
|---|---|---|---|
| 2,205,052 | 6/1940 | Stein | 242/67.3 R |
| 3,600,086 | 8/1971 | Cates | 242/55 |
| 3,737,230 | 6/1973 | Meijei | 242/67.3 R |
| 3,974,974 | 8/1976 | Nishikawa | 242/55 |

*Primary Examiner*—Edward J. McCarthy

*Attorney, Agent, or Firm*—J. J. Ralabate; C. A. Green; H. Fleischer

[57] ABSTRACT

An apparatus in which a photoconductive belt is incremented to advance unused portions thereof to an operative location as used portions advance to an inoperative location. The apparatus advances automatically portions of the photoconductive belt as the belt support member moves a pre-selected interval.

9 Claims, 3 Drawing Figures

PHOTOCONDUCTOR INCREMENTING APPARATUS

The foregoing abstract is neither intended to define the invention disclosed in the specification, nor is it intended to be limiting as to the scope of the invention in any way.

BACKGROUND OF THE INVENTION

This invention relates generally to an electrophotographic printing machine, and more particularly concerns an apparatus for advancing incremental portions of a photoconductive belt employed therein.

In a typical electrophotographic printing machine, the photoconductive member is charged to a substantially uniform level. A light image of an original document irradiates the charged portion of the photoconductive member selectively dissipating the charger thereon. This records an electrostatic latent image of the original document on the photoconductive member. The electrostatic latent image is developed with charged particles. These particles are transferred from the latent image to the sheet of support material. Thereafter, the particles are permanently affixed to the sheet of support material forming a copy of the original document.

In general, the photoconductive member is charged each time a copy is made. After a plurality of copies is have been made, i.e. 10,000 or more copies, the photoconductive layer frequency suffers fatigue from discharge breakdown. When the photoconductive material has fatigure, it shows a markedly lower efficiency in forming electrostatic latent images and in transferring the tone powder image to the sheet of support material. At this time, it becomes extremely difficult to produce high quality copies. Thus, the photoconductive member should be replaced. Frequently, it is difficult to change the photoconductive member. Thus, various techniques have been developed to introduce an unused photoconductive member into the operative location of the electrophotographic printing machine. For example, U.S. Pat. No. 3,877,806 issued to Schrempp et al in 1975 discloses a photoconductive web stored on a spool. The belt is incrementally advanced from the spool land entrained about a pair of opposed spaced rollers to form a triangular belt configuration. An alternate approach is described in U.S. Pat. No. 3,926,515 issued to Nagahara in 1975. This patent teaches the use of a photoconductive strip wound on a supply reel and a take-up reel. Both the supply reel and the take-up reel are disposed within a cylindrical support. A photoconductive strip is advanced, in discrete steps, so that the entire portion of the photoconductive strip entrained about the cylindrical member is removed therefrom when it is fatigued. U.S. Pat. No. 3,600,086 issued to Cates in 1971 discloses an apparatus for automatically advancing or replacing a reusable photoconductor element in an electrophotographic printing machine. The photoconductive element is stored on supply and take-up rolls located within the interior of a drum. A counter is actuated each time a copy is reproduced. When a pre-set number of copies have been made, the electrophotographic printing machine is automatically cycled into a photoconductor advance mode. This causes a new length of photoconductive material to be drawn from the supply roller and disposed about the outer periphery of the drum. A second counter records the number of time the photoconductive material is advanced and provides an indication to the machine operator when the photoconductor supply is exhausted. U.S. Pat. No. 3,588,242 issued to Burlier in 1971 discloses an electrophotographic printing machine having a drum which permits automatic advancement of a reusable photoconductive web. The photoconductive element is stored on a supply roll and advanced to a take-up roll. Both of the rolls are located within the interior of the drum. Advancement of the photoconductive element is initiated by engaging a clutch which drivingly couples a normally free-wheeling drive train to the advancing mechanism. This causes advancement of the photoconductive element as the copy drum is rotated by the drive motor used to turn during the copying operations. A metering apparatus is located within the interior of the copy drum and actuates a switch to terminate the advancing operation when a pre-determined length has been advanced.

Although the photoconductive drum structures hereinbefore described effectively provide a long life by virture of the storage of replacement sections of the photoconductive belt therein, these mechanisms are complex and frequently difficult to maintain.

It is an object of the present invention to improve the photoconductive belt incrementing mechanism employed in an electrophotographic printing machine.

SUMMARY OF THE INVENTION

Briefly stated, and in accordance with the features of the present invention, there is provided an apparatus for incrementing a photoconductive belt to advance unused portions thereof to an operative location as used portions advance to an inoperative location.

Pursuant to the present invention, the apparatus includes a movable support member having an interior chamber with the exterior surface thereof defining a path for entraining the photoconductive belt thereabout. The support member has an aperture between the exterior surface and the interior chamber. Means, disposed in the chamber of the support member, store unused portions of the photoconductive belt. Other means, disposed also in the chamber of the support member, store used portions of the photoconductive belt. Advancing means advance automatically portions of the photoconductive belt from the storing means to the receiving means. As the photoconductive belt advances, it passes through the aperture in the support member with one surface thereof contacting the exterior surface of the support member. Means are provided for actuating periodically the advancing means in response to the support member moving a pre-selected interval.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included in the spirit and scope of the invention as defined by the appended claims.

DETAILED DESCRIPTION OF THE INVENTION

Figure 1:
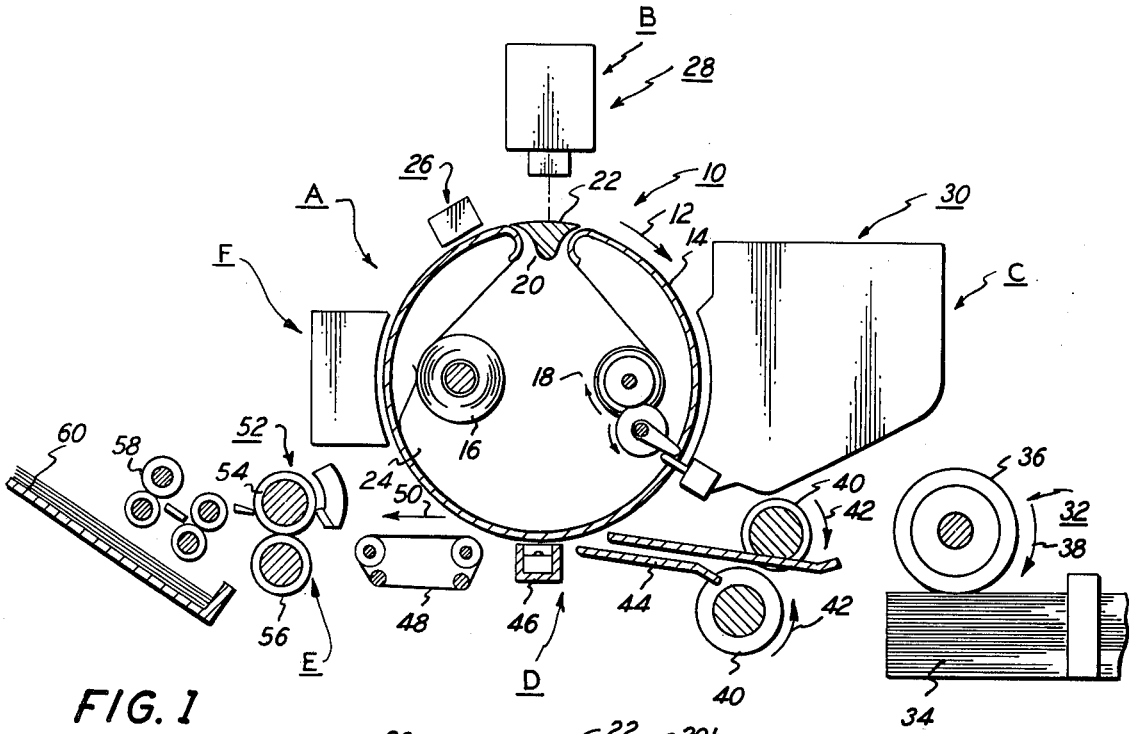
FIG. 1 depicts schematically, in elevation, an electrophotographic printing machine incorporating the features of the present invention therein.

For a general understanding of an electrophotographic printing machine incorporating the features of the present invention therein, reference is made to FIG. 1 which depicts schematically the various components thereof. Hereinafter, like reference numerals will be employed throughout the drawings to designate identical elements. Although the incrementing apparatus of the present invention is particularly well adapted for use with a photoconductive belt, it is equally well suited for use in a wide variety of devices and is not necessarily limited to the particular embodiment shown herein.

Inasmuch as the practice of electrophotographic printing is well known in the art, the various processing stations for producing a copy of an original document are hereinafter represented schematically. Each station will be described briefly.

Figure 3:
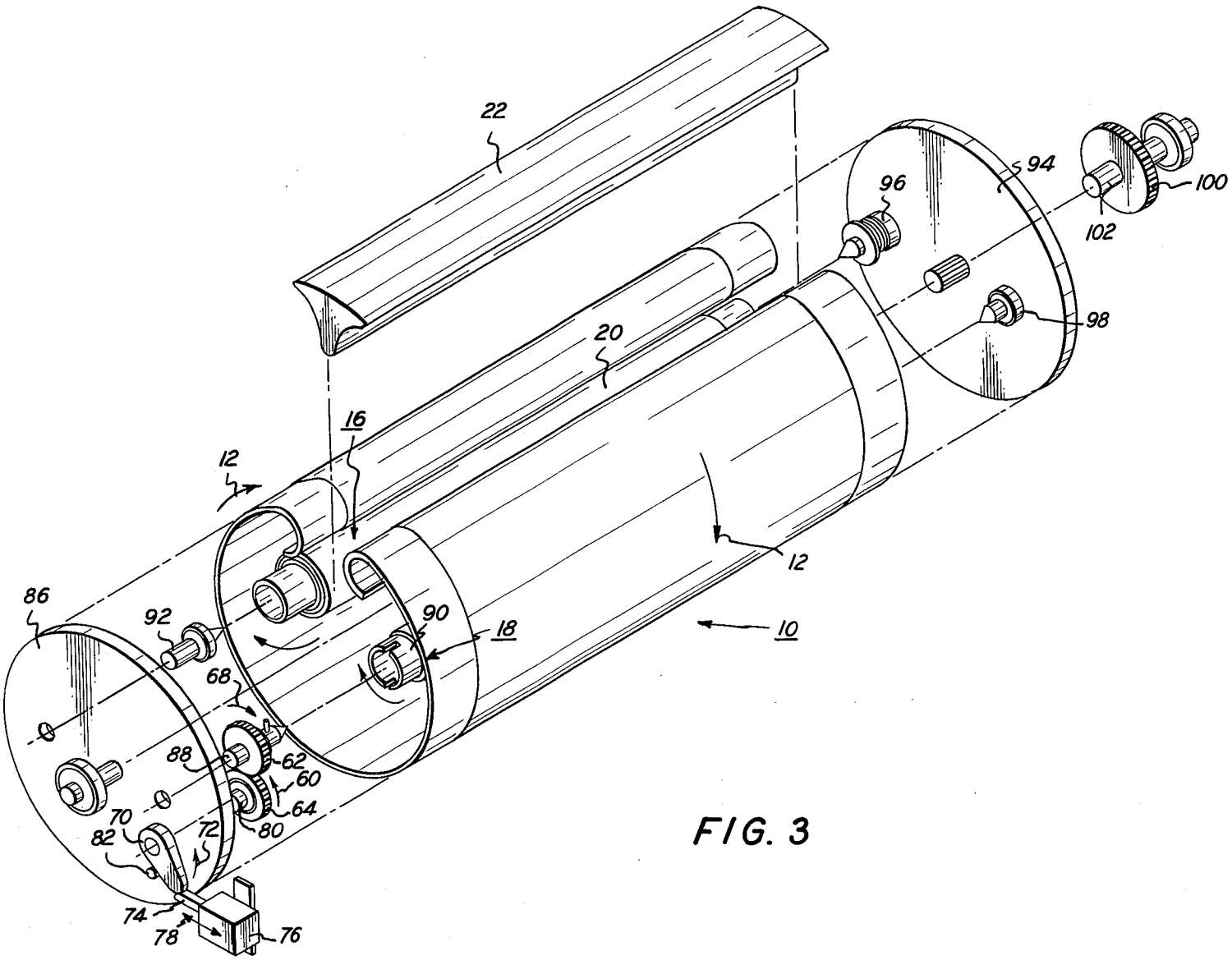
FIG. 3 illustrates an exploded perspective view of the FIG. 2 photoconductive drum.

As in all electrophotographic printing machines of the type illustrated, drum 10 is rotated about its axis in the direction of arrow 12 by a drive motor (not shown) acting through drive gear 100 (FIG. 3). Disposed on the outer periphery of drum 10 is a photoconductive belt, generally designated by the reference numeral 14. Photoconductive belt 14 preferably comprises a layer of selenium disposed on a conductive substrate such as aluminum. In lieu thereof, a suitable organic photoconductive material may be employed, such as a polyvinylcarbazole. Photoconductive belt 14 is flexible with the unused portion thereof being wound about supply spool 16 and the used portion thereof being wound about take-up spool 18. Drum 10 comprises a tubular member having a longitudinally extending slot 20 therein. Arcuate seal 22 encloses slot 20. The exterior surface of seal 22 has a curvature substantially equal to the curvature of drum 10. Thus, the exterior surface of seal 22 complements the exterior surface of drum 10 to form a closed cylinder. Supply spool 16 and take-up spool 18 are located in an interior chamber 24 of drum 10.

Initially, a portion of photoconductive belt 14 entrained about the circumferential surface of drum 10 passes through charging station A. Charging station A employs a corona generating device, indicated generally by the reference numeral 26, to sensitize the surface of photoconductive belt 14. Corona generating device 26 is positioned closely adjacent to photoconductive belt 14. When energized, corona generating device 26 charges photoconductive belt 14 to a relatively high substantially uniform potential. For example, corona generating device 26 may be of the type described in U.S. Pat. No. 2,836,725 issued to Vyverberg in 1958. Thereafter, drum 10 rotates in the direction of arrow 12 so that the charged portion of photoconductive belt 14 moves to exposure station B.

Exposure station B includes an exposure mechanism 28 having a transparent platen, such as a glass plate or the like supporting an original document thereon. Lamps illuminate the original document. Scanning of the original document may be achieved by oscillating a mirror in a timed relationship with the movement of drum 10. This mirror is positioned beneath the platen and adapted to reflect the light image of the original document through a lens onto another mirror, which, in turn, reflects the light image through an apertured slit onto the charged portion of photoconductive belt 14. Irradiating the charged portion of photoconductive belt 14 records an electrostatic latent image thereon corresponding to the original document.

Drum 10 next rotates the electrostatic latent image recorded on photoconductive belt 14 to development station C. Development station C includes a developer unit 30 having a housing containing a supply of developer mix therein. Preferably the developer mix comprises a carrier granules with toner particles adhering triboelectrically thereto. The carrier granules are preferably formed from a magnetic material with the toner particles being made from a heat settable plastic. Developer unit 30 is preferably a magnetic brush development system. In such a system, the developer mix is brought through a directional flux field to form a brush thereof. The electrostatic latent image recorded on photoconductive belt 14 is developed by bringing the brush of developer mix into contact therewith. In this manner, toner particles are attracted electrostatically to the latent image forming a toner powder image on photoconductive belt 14.

Turning briefly to the sheet feeding path, a sheet of support material is advanced by sheet feeding apparatus 32 to transfer station D. Sheet feeding apparatus 32 includes a feed roll 34 contacting the uppermost surface of the stack of the support material 36. Feed roll 34 rotates in the direction of arrow 38 to advance the uppermost sheet from stack 34. Registration rollers 40, rotating in the direction of arrow 42, align and forward the advancing sheet of support material into chute 44. Chute 44 directs the advancing sheet of support material into contact with photoconductive belt 14 in a timed sequence so that the toner powder image developed thereon is deposited on the advancing sheet of support material at transfer station D.

Transfer station D includes a corona generating device 46 which applies a spray of ions to the backside of the sheet of support material. This attracts the toner powder image from photoconductive belt 14 to the sheet of support material.

After transferring the toner powder image to the sheet of support material, conveyer 48 advances the sheet of support material in the direction of arrow 50 to fusing station E. Fusing station E includes a fusing apparatus 52 comprising a pair of opposed rollers 54 and 56. Fuser roller 54 is heated while back-up roller 56 remains unheated. The sheet of support material passes between rollers 54 and 56 with the toner powder image thereon contacting heated fuser roller 54. In this manner, the toner powder image is permanently fused to the sheet of support material. After the fusing process, rollers 58 advance the sheet of support material to catch tray 60 for subsequent removal therefrom by the machine operator.

Frequently, after transferring the toner powder image to the sheet of support material from photoconductive belt 14, some residual toner particles remain adhering thereto. These toner particles are removed from photoconductive belt 14 at cleaning station F. Initially, the residual toner particles are brought under the influence of a corona generating device adapted to neutralize the remaining electrostatic charge on photoconductive belt 14 and that of the toner particles. The neutralized toner particles are cleaned from photoconductive belt 14 by a rotatably mounted fibrous brush in contact therewith. Subsequent to cleaning, a discharge lamp floods photoconductive belt 14 with light to dissipate any residual electrostatic charge remaining thereon prior to the charging thereof for the initiation of the next successive copying cycle.

Figure 2:
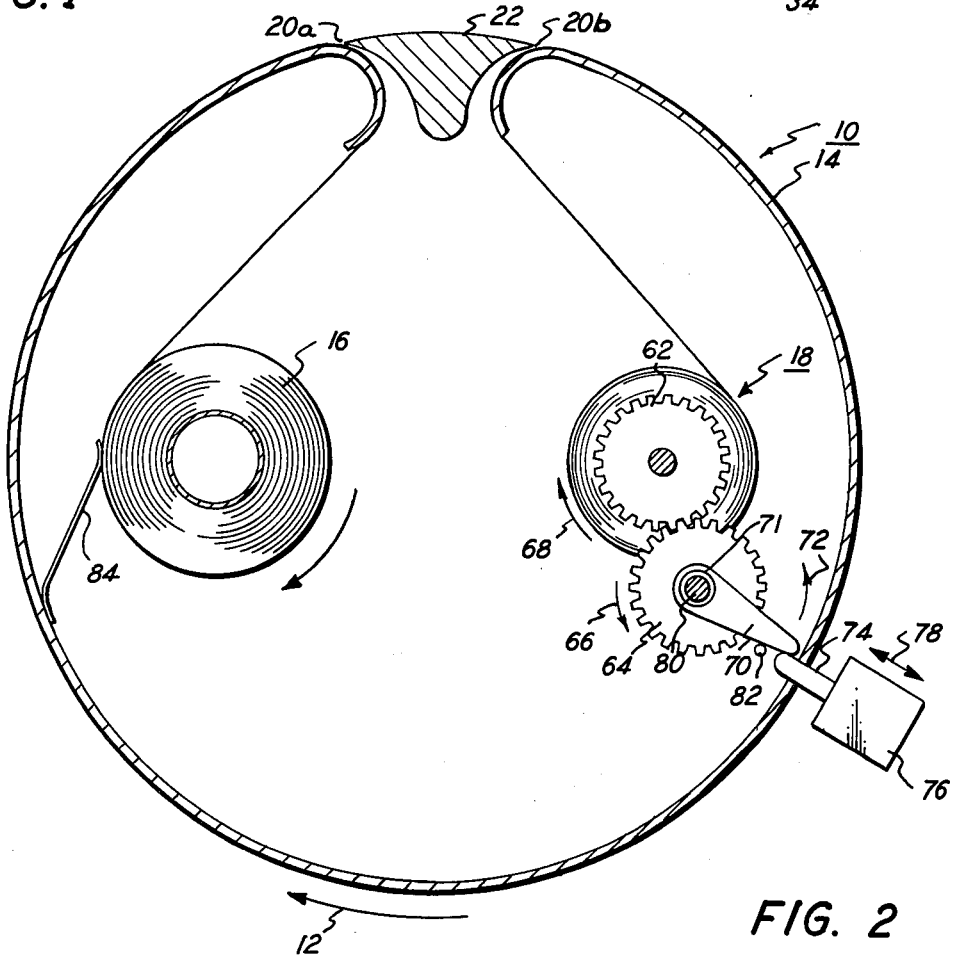
FIG. 2 shows an elevational view of the photoconductive drum employed in the FIG. 1 printing machine.

It is believed that the foregoing description is sufficient for purposes of the present application to illustrate the general operation of an electrophotographic printing machine incorporating the features of the present invention therein. Referring now to the specific subject matter of the present invention, FIGS. 2 and 3 depict the incrementing apparatus for advancing photoconductive belt 14. Photoconductive belt 14 advances a pre-selected length at a pre-selected interval of time.

As shown in FIG. 2, take-up spool 18 has a take-up gear 62 mounted on one end of the support shaft thereof. Take-up gear 62 meshes with drive gear 64. Thus, rotation of drive gear 64 in the direction of arrow 66 rotates take-up gear 62 in the direction of arrow 68. Rotation of gear 62 in the direction of arrow 68, rotates take-up spool 18 also in the direction of arrow 68 so as to advance the used portion of photoconductive belt 14 thereon and to advance unused portions of photoconductive belt 14 from supply spool 16 about the exterior surface of drum 10. Arm 70 is connected to gear 64. Rotation of arm 70 in the direction of arrow 72 rotates gear 64 in the direction of arrow 66. As drum 10 rotates in the direction of arrow 12, arm 70 contacts shaft 74 of solenoid 76. Shaft 74 of solenoid 76 extends into contact with arm 70 only upon being energized. When solenoid 76 is de-energized, shaft 74 is retracted and will no longer engage arm 70. Thus, shaft 74 is adapted to reciprocate in the direction of arrow 78.

In operation, drum 10 rotates in the direction of arrow 12 causing arm 70 to engage shaft 74 of solenoid 76. When arm 70 engages shaft 74 of solenoid 76, it pivots in the direction of arrow 72. As arm 70 pivots in the direction of arrow 72, gear 64 rotates in the direction of arrow 66. Rotation of gear 64 in the direction of arrow 66 rotates gear 62 in the direction of arrow 68. As gear 62 rotates in the direction of 68, takeup spool 18 also rotates in the direction of arrow 68. This advances portions of photoconductive belt 14 from supply spool 16 onto take-up spool 18. As shown in FIG. 2, photoconductive belt 14 extends from supply spool 16 through slot **20*a* about the exterior surface of drum 10 and back through slot 20*b* to take-up roll 18. Seal 22 in combination with drum 10 defines slots 20*a* and 20*b***.

As drum 10 continues to rotate in the direction of arrow 12, arm 70 no longer engages shaft 74. At this time, photoconductive belt 14 is not advanced and remains stationary. Clutch 80 couples arm 70 to gear 64. Thus when arm 70 rotates in the direction of arrow 72, clutch 80 couples arm 70 to gear 64 so that gear 64 rotates therewith. Contrawise, when arm 70 rotates in a direction opposed to arrow 72, clutch 80 decouples arm 70 from gear 64 so that arm 70 does not rotate therewith. When arm 70 is disengaged from shaft 74, a coil spring 71 resiliently urges arm 70 into engagement with stop pin 82. A leaf spring 84 having one end portion thereof secured to the interior surface of drum 10 and the other end portion thereof engaging the unused portions of photoconductive belt 14 prevents supply spool 16 from unwinding too rapidly. Leaf spring 84 exerts a frictional drag on photoconductive belt 14 wound about supply spool 16 so as to insure that one surface of photoconductive belt 14 remains in contact with the exterior circumferential surface of drum 10. Solenoid 76 is actuated at pre-selected intervals of time. Thus, arm 70 may engage shaft 74 of solenoid 76 at each revolution of drum 10 or multiples thereof. For example, if solenoid 76 were actuated one time every five revolutions of drum 10, photoconductive belt 14 would advance only one time for every five revolutions of drum 10. Similarly, if solenoid 76 were actuated for each revolution of drum 10, photoconductive belt 14 would advance every revolution of drum 10.

Actuation of solenoid 76 may be regulated by a timing disc (not shown) mounted on one end of the shaft supporting the drum 10. The timing disc rotates with drum 10. This timing disc comprises a plurality of slits in the exterior circumferential surface thereof. A light source is disposed on one side of the opaque timing disc and a photosensor is located on the other side thereof. As the slits pass between the light source and photosensor, the photosensor detects the intensity of the light rays and develops an electrical signal. This electrical signal is processed by suitable logic circuitry to energize solenoid 76. For example, if four slits are disposed about the periphery of the timing discus, and the solenoid is actuated every 16 pulses, photoconductive belt 14 will be advanced once per four revolutions of drum 10.

Referring now to FIG. 3, there is shown an exploded perspective view of drum 10. As depicted thereat, gear 62 is mounted on shaft 88 attached rotatably to end plate 86. Gear 64 is mounted on shaft 80 coupled to arm 70 through clutch 80. Shaft 80 is also mounted on end plate 86. Shaft 92, mounted on end plate 86, mates with supply spool 16. Similarly, shaft 88, mates via key 90 with take-up spool 18.

Both gear 62 and gear 64 are disposed on one surface of end plate 86 with arm 70 being located on the opposed surface of end plate 86. End plate 86 encloses one end of tubular member 10. Stop pin 82 is also mounted on the same side of end plate 86 as arm 70. Thus, gears 62 and 64 are mounted in chamber 24 of drum 10 while arm 70 and stop pin 82 are mounted exterior thereto. This enables arm 70 to engage shaft 74 of solenoid 76 when solenoid 76 is energized. Solenoid 76 is mounted stationarily relative to drum 10 on the printing machine frame. Seal 22 is adapted to close slot 20 while permitting photoconductive belt 14 to pass therebetween in slots **20*a* and 20*b*, respectively. End plate 94 is provided for enclosing the other end of tubular member 10. End plate 94 has shafts 96 and 98 mounted thereon adapted to engage and support supply spool 16 and take-up spool 18, respectively. Gear 100 is secured to shaft 102 which connects end plate 94 with end plate 86 and locks the entire assembly together. A drive motor (not shown) having a gear (not shown) thereon meshes with gear 100 to rotate drum 10 in the direction of arrow 12**.

In recapitulation, it is apparent that pursuant to the features of the present invention, heretofore described, the apparatus advances the photoconductive belt from an operative location to an inoperative location. This is achieved as the drum having the photoconductive belt entrained thereabout rotates through a pre-selected interval. In this manner, successive unused portions of the photoconductive belt are advanced to the operative location. The photoconductive belt is entrained about the exterior circumferential surface of the tubular member. As the tubular member rotates, a solenoid is periodically actuated such that the shaft thereof engages and pivots an arm which rotates a gear, which, in turn, rotates another gear to rotate the take-up spool for advancing the photoconductive belt from the supply spool. This is relatively inexpensive and simple incrementing mechanism that is easily repairable and minimizes potential damage to the photoconductive belt.

It is, therefore, evident that there has been provided, in accordance with the present invention, an apparatus for periodically incrementing a photoconductive belt. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for incrementing a photoconductive belt to advance unused portions thereof to an operative location as used portions thereof advance to an inoperative location, including:

a movable support member having an interior chamber with the exterior surface thereof defining a path for entraining the photoconductive belt thereabout, said support member having an aperture between the exterior surface thereof and the interior chamber;

means, disposed in the chamber of said support member, for storing the unused portions of the photoconductive belt;

means, disposed in the chamber of said support member, for receiving the used portions of the photoconductive belt;

means for advancing automatically portions of the photoconductive belt from said storing means to said receiving means with the photoconductive belt passing through the aperture in said support member and having one surface thereof in contact with the exterior surface of said support member; and means for actuating periodically said advancing means in response to said support member moving a pre-selected interval.

2. An apparatus as recited in claim 1, wherein said advancing means includes:

a first gear coupled to said receiving means, said first gear rotating to move used portions of the photoconductive belt onto said receiving means;

a second gear meshing with said first gear;

an arm operatively associated with said actuating means;

a clutch coupling said arm to said second gear when said arm rotates in a first direction, and de-coupling said arm from said second gear when said arm rotates in the second direction opposed to the first direction;

a stop member; and means for resiliently urging said arm to rotate in the second direction so that said arm engages said stop member.

3. An apparatus as recited in claim 2, wherein said actuating means includes a solenoid positioned to periodically engage said arm when energized so that said arm rotates in the first direction during engagement therebetween.

4. An apparatus as recited in claim 3, wherein said support member includes a tubular member with the aperture therein being a slot in the exterior surface thereof and extending in a longitudinal direction.

5. An apparatus as recited in claim 4, wherein said storing means includes a supply spool having the unused portions of the photoconductive belt wound thereabout.

6. An apparatus as recited in claim 5, wherein said receiving means includes a take-up spool having the used portions of the photoconductive belt wound thereabout with the photoconductive belt extending from the supply spool through the slot about the exterior surface of said tubular member and back through the slot to said take-up spool.

7. An apparatus as recited in claim 6, further including a seal having an arcuate exterior surface, said seal being disposed in the slot and being interposed between the portion of the photoconductive belt extending from the supply spool and the portion of the photoconductive belt extending to the take-up spool.

8. An apparatus as recited in claim 7, further including means for frictionally retarding the rotation of said supply spool.

9. An apparatus as recited in claim 8, further including a pair of end plates, each end plate arranged to be mounted on an end of said tubular member with the longitudinal axis of said tubular member being substantially normal to said pair of end plates, one of said end plates having said first gear and said second gear mounted on the surface of said end plate disposed in the chamber of said tubular member and said arm being mounted on the other surface of said end plate exterior to the chamber of said tubular member.

* * * * *